US009041367B2

(12) United States Patent
Dao et al.

(10) Patent No.: US 9,041,367 B2
(45) Date of Patent: May 26, 2015

(54) VOLTAGE REGULATOR WITH CURRENT LIMITER

(71) Applicants: Chris C. Dao, Pflugerville, TX (US); Stefano Pietri, Austin, TX (US); Juxiang Ren, Austin, TX (US)

(72) Inventors: Chris C. Dao, Pflugerville, TX (US); Stefano Pietri, Austin, TX (US); Juxiang Ren, Austin, TX (US)

(73) Assignee: FREESCALE SEMICONDUCTOR, INC., Austin, TX (US)

( * ) Notice: Subject to any disclaimer, the term of this patent is extended or adjusted under 35 U.S.C. 154(b) by 86 days.

(21) Appl. No.: 13/828,213

(22) Filed: Mar. 14, 2013

(65) Prior Publication Data

US 2014/0266098 A1 Sep. 18, 2014

(51) Int. Cl.

| | |
|---|---|
| ***G05F 1/00*** | (2006.01) |
| ***G05F 1/573*** | (2006.01) |
| *G05F 1/575* | (2006.01) |

(52) U.S. Cl.

CPC ..... *G05F 1/573* (2013.01); *G05F 1/575* (2013.01)

(58) Field of Classification Search

USPC ..... 323/273–283, 311–317; 361/89

See application file for complete search history.

(56) References Cited

U.S. PATENT DOCUMENTS

| | | | | |
|---|---|---|---|---|
| 6,246,555 | B1 | 6/2001 | Tham | |
| 6,346,799 | B2 | 2/2002 | Renous | |
| 6,407,537 | B2 | 6/2002 | Antheunis | |
| 6,952,091 | B2 | 10/2005 | Bansal | |
| 6,977,491 | B1 | 12/2005 | Caldwell et al. | |
| 7,511,464 | B2 * | 3/2009 | Suzuki | 323/275 |
| 7,602,162 | B2 * | 10/2009 | Bansal et al. | 323/277 |
| 7,755,337 | B2 * | 7/2010 | Negoro | 323/277 |
| 7,768,339 | B2 * | 8/2010 | Suzuki | 327/513 |
| 7,852,054 | B2 * | 12/2010 | Kao et al. | 323/277 |
| 2010/0201332 | A1 * | 8/2010 | Le et al. | 323/280 |
| 2014/0084881 | A1 * | 3/2014 | Shih et al. | 323/269 |

* cited by examiner

*Primary Examiner* — Timothy J Dole
*Assistant Examiner* — Htet Kyaw

(57) ABSTRACT

A voltage regulator includes an amplifier having a first input coupled to a first reference voltage and a second input coupled to a voltage feedback signal; a multiplexer having a first input coupled to an output of the amplifier, a second input coupled to a voltage clamp signal, and a control input; and a control circuit having a first input coupled to an over current indicator, a second input coupled to a no over voltage indicator, a third input coupled to a timer signal, and an output coupled to the control input of the multiplexer.

20 Claims, 5 Drawing Sheets

10

200

VOLTAGE REGULATOR WITH CURRENT LIMITER

BACKGROUND

1. Field

This disclosure relates generally to integrated circuits, and more specifically, to a voltage regulator with current limiter.

2. Related Art

Voltage regulators are commonly used in a variety of integrated circuits. However, over current conditions and over voltage conditions may result in permanent damage to an IC. Therefore, in order to prevent damage due to these conditions, protections are needed for voltage regulators.

BRIEF DESCRIPTION OF THE DRAWINGS

The present invention is illustrated by way of example and is not limited by the accompanying figures, in which like references indicate similar elements. Elements in the figures are illustrated for simplicity and clarity and have not necessarily been drawn to scale.

DETAILED DESCRIPTION

In one embodiment, a voltage regulator includes an over current detection circuit that opens the voltage regulator feedback loop to clamp the current when an over current condition occurs. The over-current detection circuit opens the feedback loop for a predetermined amount of time in response to the over-current condition. After the predetermined amount of time, the feedback loop is once again closed and the detection circuit continues to monitor for occurrence of an over current condition. Upon opening the feedback loop, the voltage regulator is no longer regulating voltage. However, while the feedback loop is operating as an open loop, an over voltage condition may occur due, for example, to a sudden drop in current demand. Therefore, an over voltage detection circuit, in response to detection of an over voltage condition, closes the feedback loop, regardless of whether or not the predetermined amount of time has expired.

Figure 1:
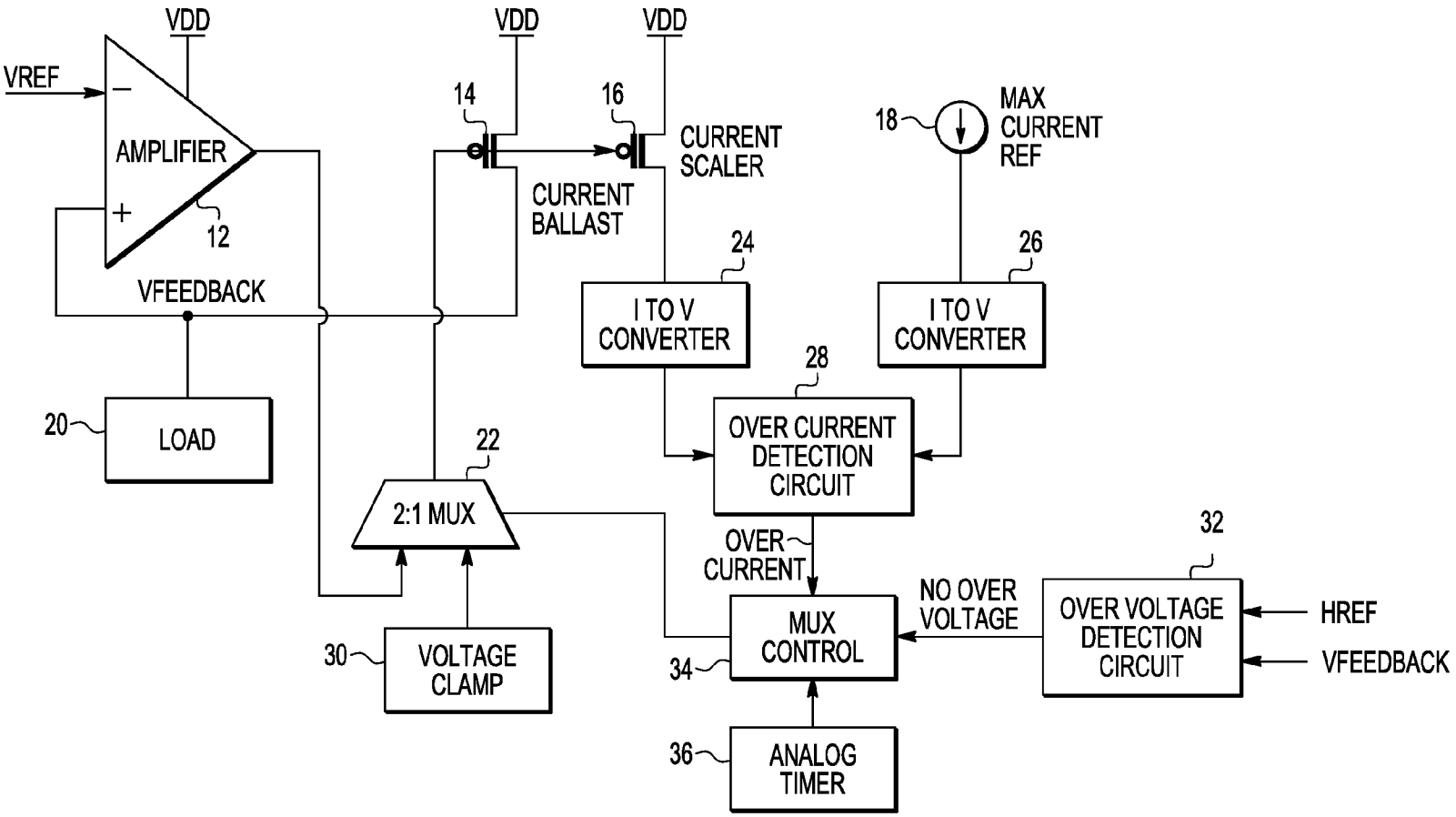
FIG. 1 illustrates, in partial block diagram and partial schematic form, a voltage regulator in accordance with one embodiment of the disclosure.

FIG. 1 illustrates, in partial schematic and partial block diagram form, a voltage regulator 10 in accordance with one embodiment of the present invention. Voltage regulator 10 includes an amplifier 12, a PMOS transistor 14 (which may also be referred to as a ballast transistor), a PMOS transistor

16 (which may also be referred to as a current scalar transistor), a multiplexer (MUX) 22, a voltage clamp 30, current to voltage converter 24, a maximum current reference 18, current to voltage converter 26, an over current detection circuit 28, an over voltage detection circuit 32, a MUX control unit 34, and an analog timer 36. FIG. 1 also includes a load circuit 20 which is coupled to the regulator output voltage, VFEEDBACK. Amplifier 12 is coupled to a first power supply voltage terminal to receive a first power supply voltage, VDD, has a negative input coupled to receive a first reference voltage, VREF, and a positive input coupled to receive VFEEDBACK (note that the VFEEDBACK may also be referred to as a voltage feedback signal). An output of amplifier 12 is coupled to a first input of MUX 22. An output of MUX 22 is coupled to a control electrode (e.g. gate terminal) of transistor 14. A first current electrode (e.g. a source terminal) of transistor 14 is coupled to VDD, and a second current electrode (e.g. a drain terminal) of transistor 14 is coupled to the positive input of amplifier 12 and provides VFEEDBACK. Voltage clamp 30 is coupled to a second input of MUX 22. A first current electrode (e.g. a source terminal) of transistor 16 is coupled to VDD, a control electrode (e.g. gate terminal) of transistor 16 is coupled to the control gate of transistor 14, and a second current electrode (e.g. drain terminal) of transistor 16 is coupled to current to voltage converter 24. Maximum current reference 18 is coupled to current to voltage converter 26. Over current detection circuit 28 has a first input coupled to current to voltage converter 24 and a second input coupled to current to voltage converter 26, and provides an over current indicator to MUX control 34. Over voltage detection circuit is coupled to receive a second reference voltage, HREF, is coupled to receive VFEEDBACK, and provides a no over voltage indicator to MUX control 34. Analog timer 36 provides a timer signal to MUX control 34, and MUX control 34 provides a select signal to a control input of MUX 22.

During operation, when voltage regulator 10 is operating in closed loop, in which the output of amplifier 12 is coupled, via MUX 22, to the control gate of transistor 14, amplifier 12 controls the voltage on the control gate of transistor 14 in order to regulate VFEEDBACK. For example, if the current demand of load 20 increases, VFEEDBACK begins to drop. Based on the drop in VFEEDBACK, amplifier 12 reduces the voltage on the control gate of transistor 14 so as to increase the current through transistor 14 to load 20. However, if the current demand of load 20 exceeds a maximum allowed current, an over current condition occurs. An over current condition may occur, for example, when load 20 is failing or when there is thermal instability within load 20. Therefore, the current through transistor 16, which provides a scaled down version of the current through transistor 14 that is consumed by load 20, is continuously monitored by over current detection circuit 28. The scaled down current is converted to a voltage by current to voltage converter 24. Maximum reference current 18 (which corresponds to the maximum allowed current of load 20) is converted to a voltage by current to voltage converter 26. Over current detection circuit 28 continuously compares the output of current to voltage converter 24 to the output of current to voltage converter 26 to determine if the output of current to voltage converter 24 exceeds the output of current to voltage converter 26, which indicates occurrence of an over current condition. In response to detection of an over current condition, MUX control 34 controls MUX 22 such that the output of voltage clamp 30 is coupled to the control electrode of transistor 14 rather than the output of amplifier 12, thus opening the feedback loop and clamping the control gate of transistor 14. While clamped, the current through transistor 14 is limited. In the illustrated embodiment, upon clamping the control gate of transistor 14, analog timer 36 is activated, and upon analog timer expiring, MUX control 34 control MUX 22 such that the output of amplifier 12 is again coupled to the control gate of transistor 14 so as to close the feedback loop again and allow voltage regulation to continue.

When the feedback loop is open and the control gate of transistor 14 is clamped by voltage clamp 30, an over voltage condition may occur in which the current demand of load 20 drastically drops. Therefore, over voltage detection circuit 32 monitors VFEEDBACK, comparing VFEEDBACK to HREF. In one embodiment, HREF is slightly greater than VREF. If, due to a change in load 20, VFEEDBACK goes above HREF, thus indicating an over voltage condition, MUX control 34 changes the control signal to MUX 22 so as to again couple the output of amplifier 12 to the control gate of transistor 14, regardless of whether or not analog timer 36 has expired, thus closing the feedback loop and again allowing voltage regulator 10 to regulate VFEEDBACK. That is, when an over voltage condition is detected, the feedback loop is immediately closed in response thereto, even if analog timer 36 has not yet expired.

Figure 6:
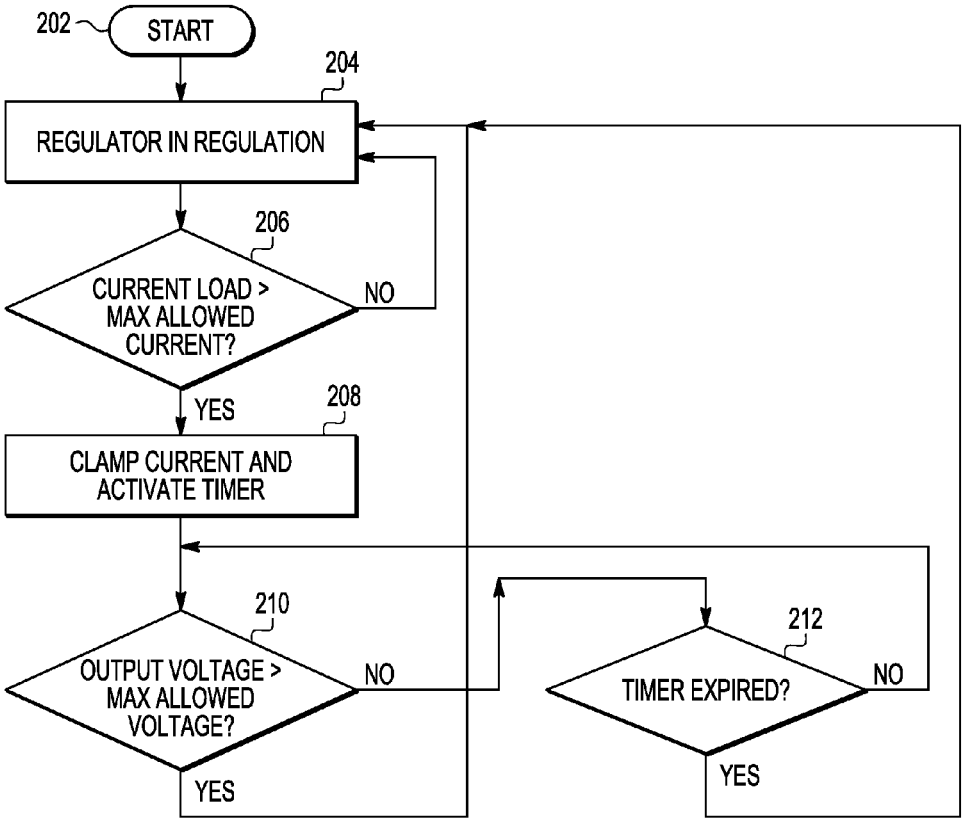
FIG. 6 illustrates, in flow diagram form, a method of operation of the voltage regulator of FIG. 1 in accordance with one embodiment of the disclosure.

Operation of FIG. 1 can further be described in reference to method 200 of FIG. 6. Method 200 begins with power-up of voltage regulator 10 in block 202. Method 200 then proceeds to block 204 in which voltage regulator 10 is in regulation. That is, voltage regulator 10 operates in closed loop in which MUX 22 couples the output of amplifier 12 to the control electrode of ballast transistor 14. Method 200 then proceeds to decision diamond 206 in which it is determined whether an over current condition exists. That is, if over current detection circuit 28 detects that the current demand of load 20 (represented by the current provided to current to voltage converter 24) is greater than the maximum allowed current (represented by maximum current reference 18), then an over current condition exists, and method 200 proceeds to block 208 in which MUX 22 couples voltage clamp 30 to the control electrode of ballast transistor 14 and analog timer 36 is activated. If, however, an over current condition was not detected in decision diamond 206, method 200 returns to block 204 in which voltage regulator 10 continues to regulate VFEEDBACK.

Upon activation of analog timer 36, in block 308, method proceeds to decision diamond 210 in which it is determined whether an over voltage condition exists. That is, if over voltage detection circuit 32 detects that the regulator output voltage, VFEEDBACK, is greater than the maximum allowed voltage (represented by HREF), then an over voltage condition exists, and method 200 proceeds to block 204 in which MUX 22 again couples the output of amplifier 12 to the control electrode of transistor 14. This closes the feedback loop and allows voltage regulator to again regulate VFEEDBACK. If, however, an over voltage condition was not detected in decision diamond 210, method 200 proceeds to decision diamond 212 in which it is determined whether or not the timer has expired. If so, method 200 returns to block 204 in which voltage regulator again regulates VFEEDBACK. If the timer has not yet expired, though, method 200 returns to decision diamond 210 to continue to check whether or not an over voltage condition exists. If, at any time before timer 36 has expired, an over voltage condition is detected, method 200 immediately returns to block 204 in which the feedback loop is closed without waiting for timer 36 to expire. If no over voltage condition is detected, then method 200 returns to block 204 upon expiration of timer 36.

Figure 2:
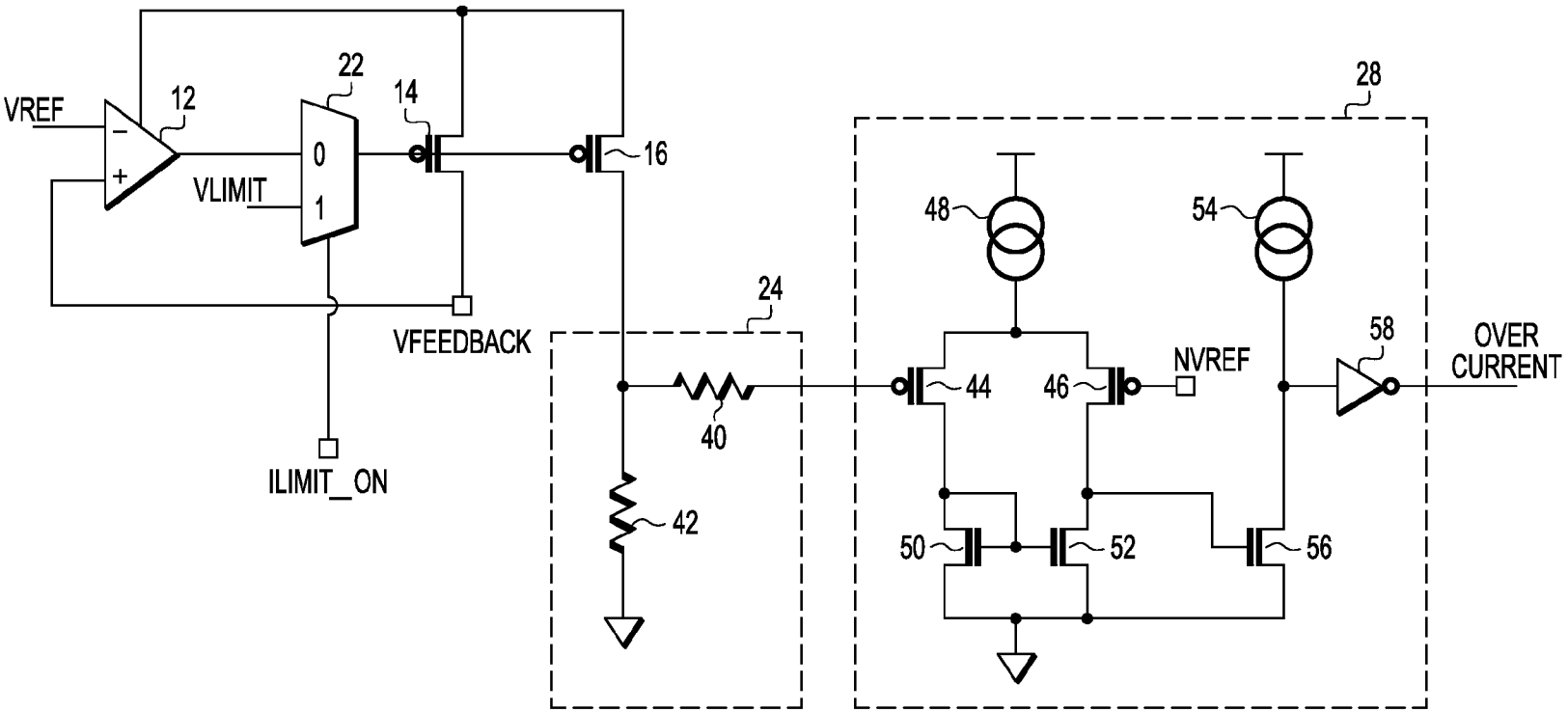
FIG. 2 illustrates, in partial block diagram and partial schematic form, a portion of the voltage regulator of FIG. 1 in further detail, in accordance with one embodiment of the disclosure.

FIGS. 2-5 illustrate, in partial block diagram and partial schematic form, further details of various portions of voltage regulator 10 of FIG. 1, an accordance with various embodiments. FIG. 2 illustrates amplifier 12, MUX 22, transistor 14 and 16, and further details of current to voltage converter 24 and over current detection circuit 28, in accordance with one embodiment. The signal provided to the control input of MUX 22 is labeled as ILIMIT_ON. When ILIMIT_ON is negated (e.g. a logic level low), MUX 22 couples the output of amplifier 12 to the control electrode of transistor 14 and when ILIMIT_ON is asserted (e.g. a logic level high), MUX 22 couples vlimit (representative of the voltage limit signal output by voltage clamp 30) to the control electrode of transistor 14. The second current electrode of transistor 16 is coupled to first terminals of each of resistors 42 and 40. A second terminal of resistor 42 is coupled to a second power supply voltage (e.g. ground), and a second terminal of resistor 40 is coupled to over current detection circuit 28.

Still referring to FIG. 2, over current detection circuit 28, includes current sources 48 and 54, PMOS transistors 44 and 46, NMOS transistors 50, 52, and 56, and an inverter 58. A first terminal of current source 48 is coupled to VDD and a second terminal of current source 48 is coupled to first current electrodes of transistors 44 and 46. A control electrode of transistor 44 is coupled to the second terminal of resistor 40. A second current electrode of transistor 44 is coupled to a first current electrode of transistor 50 and a control electrode of transistor 50. A control electrode of transistor 46 is coupled to receive NVREF (which corresponds to the output voltage of current to voltage converter 26). A second current electrode of transistor 46 is coupled to a first current electrode of transistor 52 and a control electrode of transistor 56. A control electrode of transistor 50 is coupled to a control electrode of transistor 52. Second current electrodes of each of transistors 50, 52, and 56 are coupled to ground. A first terminal of current source 54 is coupled to VDD, and a second terminal of current source 54 is coupled to a first current electrode of transistor 56 and an input of inverter 58. An output of inverter 58 provides an over current indicator signal, which, when asserted, indicates occurrence of an over current condition. The over current indicator signal is provided to MUX control 34.

In operation, the second terminal of resistor 40 coupled to the control gate of transistor 44 represents the output of current to voltage converter 24 and thus provides a voltage representative of the current through transistor 16 (and thus transistor 14). This voltage is compared to NVREF (which represents the maximum allowable current) by the comparator formed by transistors 44, 46, 50, and 52. If NVREF is greater than the voltage at the control electrode of transistor 44, then a low voltage signal is provided to transistor 56, resulting in transistor 56 being non-conductive. Therefore, the input of inverter 58 is pulled up to a logic level high and the over current indicator signal is negated (e.g. at a logic level low) indicating that no over current condition exists. However, if the voltage at the control electrode of transistor 44 is greater than NVREF, then a high voltage signal is provided to transistor 56, thus turning on transistor 56. In this case, the input of inverter 58 is pulled to a logic level low and the over current indicator signal is asserted (e.g. at a logic level high) indicating an over current condition has been detected.

Figure 3:
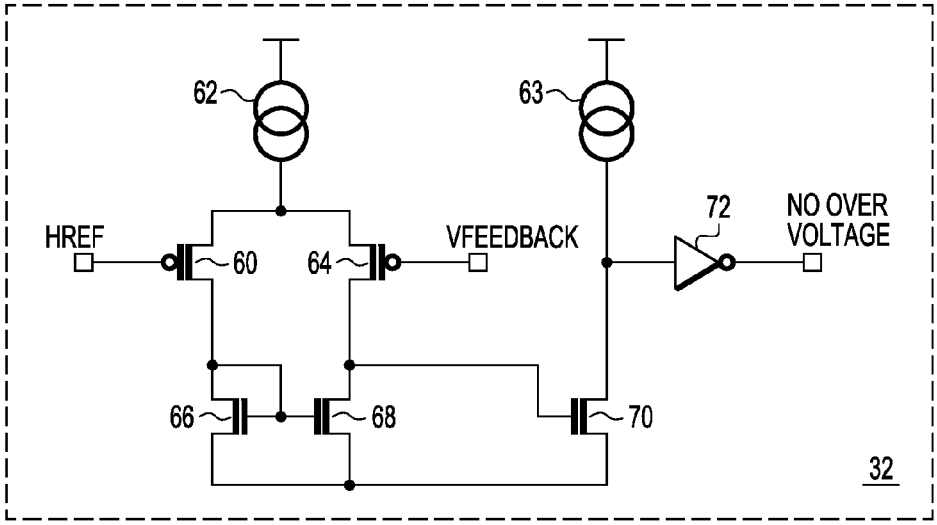
FIG. 3 illustrates, in partial block diagram and partial schematic form, another portion of the voltage regulator of FIG. 1 in further detail, in accordance with one embodiment of the disclosure.

FIG. 3 illustrates further details of over voltage detection circuit 32, in accordance with one embodiment. Over voltage detection circuit 32, includes current sources 62 and 63, PMOS transistors 60 and 64, NMOS transistors 60, 68, and 70, and an inverter 72. A first terminal of current source 62 is coupled to VDD and a second terminal of current source 62 is coupled to first current electrodes of transistors 60 and 64. A control electrode of transistor 60 is coupled to receive HREF (which is representative of the maximum allowable voltage).

A second current electrode of transistor 60 is coupled to a first current electrode of transistor 66 and a control electrode of transistor 66. A control electrode of transistor 64 is coupled to receive VFEEDBACK (which corresponds to the output voltage of voltage regulator 10). A second current electrode of transistor 64 is coupled to a first current electrode of transistor 68 and a control electrode of transistor 70. A control electrode of transistor 66 is coupled to a control electrode of transistor 68. Second current electrodes of each of transistors 66, 68, and 70 are coupled to ground. A first terminal of current source 63 is coupled to VDD, and a second terminal of current source 63 is coupled to a first current electrode of transistor 70 and an input of inverter 72. An output of inverter 72 provides a no over voltage indicator signal, which, when asserted, indicates that no over voltage condition is detected. The no over voltage indicator signal is provided to MUX control 34.

In operation, HREF (which represents the maximum allowable voltage) is compared to VFEEDBACK by the comparator formed by transistors 60, 64, 66, and 68. If VFEEDBACK is greater than HREF, then a low voltage signal is provided to transistor 70, resulting in transistor 70 being non-conductive. Therefore, the input of inverter 72 is pulled up to a logic level high and the no over voltage indicator signal is negated (e.g. at a logic level low) indicating that an over voltage condition does exist. However, if HREF is greater than VFEEDBACK, then a high voltage signal is provided to transistor 70, thus turning on transistor 70. In this case, the input of inverter 72 is pulled to a logic level low and the no over voltage indicator signal is asserted (e.g. at a logic level high) indicating that no over voltage condition exists.

Figure 4:
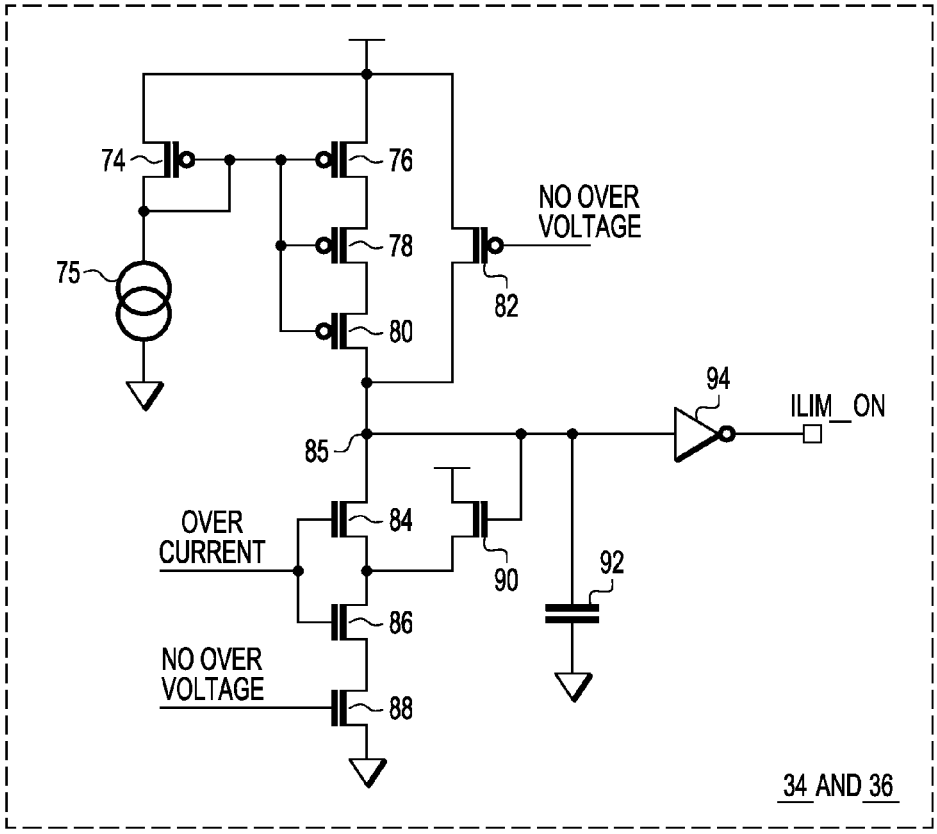
FIG. 4 illustrates, in partial block diagram and partial schematic form, another portion of the voltage regulator of FIG. 1 in further detail, in accordance with one embodiment of the disclosure.

FIG. 4 illustrates further details of MUX control 34 and analog timer 36, in accordance with one embodiment. In the illustrated embodiment, MUX control 34 includes analog timer 36. FIG. 4 includes PMOS transistors 74, 76, 78, 80, and 82, current source 75, NMOS transistors 84, 86, 88, and 90, capacitor 92, and inverter 94. A first current electrode of transistor 74 is coupled to VDD, a second current electrode of transistor 74 is coupled to a control electrode of transistor 74 and a first terminal of current source 75. A second terminal of current source 75 is coupled to ground. A first terminal of transistor 76 is coupled to VDD, a control electrode of transistor 76 is coupled to the control electrode of transistor 74. A second terminal of transistor 76 is coupled to a first terminal of transistor 78, a control electrode of transistor 78 is coupled to the control electrode of transistor 74, and a second terminal of transistor 78 is coupled to a first current electrode of transistor 80. A control electrode of transistor 80 is coupled to the control electrode of transistor 74, and a second current electrode of transistor 80 is coupled to circuit node 85. A first current electrode of transistor 82 is coupled to VDD, a control electrode of transistor 82 is coupled to receive the no over voltage indicator, and a second current electrode of transistor 82 is coupled to node 85. A first current electrode of transistor 84 is coupled to node 85, a control electrode of transistor 84 is coupled to receive the over current indicator, and a second current electrode of transistor 80 is coupled to a first current electrode of transistor 86. A control electrode of transistor 86 is coupled to the control electrode of transistor 84 and also receives the over current indicator, and a second current electrode of transistor 86 is coupled to a first current electrode of transistor 88. A control electrode of transistor 88 is coupled to receive the no over voltage indicator, and a second current electrode of transistor 88 is coupled to ground. A first current electrode of transistor 90 is coupled to VDD, a control electrode of transistor 90 is coupled to node 85, and a second current electrode of transistor 90 is coupled to the second current electrode of transistor 84. A first terminal of capacitor 92 is coupled to node 85, and a second terminal of capacitor 92 is coupled to ground. The input of inverter 94 is coupled to node 85 and an output of inverter 94 provides ILIM_ON to the control input of MUX 22, as illustrated in FIG. 2.

In operation, when ILIMIT_ON is asserted, as was described in reference to FIG. 2, MUX 22 couples voltage clamp 30 to the control electrode of transistor 14. When ILIM_ON is negated, MUX 22 couples the output of amplifier 12 to the control electrode of transistor 14. As can be seen in FIG. 4, so long as there is no over current condition (meaning the over current condition indicator is negated, e.g. a logic level low), transistors 84 and 86 are off. Furthermore, when there is no over current condition and thus the feedback loop of voltage regulator 10 is closed and VFEEDBACK is being regulated, there is no over voltage condition (meaning the no over voltage signal is asserted, e.g. a logic level high). Therefore, transistor 82 is off, and circuit node 85 gets pulled up to a logic level high via transistors 80, 78, and 76. The output of inverter 94 is a logic level low, thus ILIM_ON is negated and the output of amplifier 12 is coupled to the control electrode of transistor 14 and VFEEDBACK is being regulated by voltage regulator 10.

Still referring to FIG. 4, upon detection of an over current condition, the over current indicator provided by over current detection circuit 28 is asserted, thus turning on transistors 84 and 86. Also, initially, upon detection of an over current condition, no over voltage condition has yet been detected, therefore, transistor 88 is also turned on (since the no over voltage indicator is asserted). Therefore, node 85 is pulled down, causing the output of inverter 94 to go to a logic level high, thus asserting ILIM_ON. Upon assertion of ILIM_ON, MUX 22 couples voltage clamp 30 to the control electrode of transistor 14. Assuming no over voltage condition occurs, the circuit path created through transistors 76, 78, 80, and capacitor 92 will cause node 85, over a predetermined amount of time determined by the circuit path, to be pulled back up. Upon reaching the trip point of inverter 94, ILIM_ON will again be negated, to allow voltage regulator 10 to go back to regulating VFEEDBACK. Therefore, note that transistors 76, 78, 80, and capacitor 92 form analog timer 36 such that, upon detection of an over current condition and asserting the over current indicator, the circuit path is enabled to begin pulling up node 85. Upon node 85 reaching the trip point of inverter 94, the analog timer effectively expires.

However, if an over voltage condition occurs, over voltage detection circuit 32 negates the no over voltage indicator which results in turning on transistor 82 and turning off transistor 88. Therefore, if an over voltage condition occurs after detection of an over current condition and before expiration of analog timer 36, by turning off transistor 88 and turning on transistor 82, node 85 gets quickly pulled up (since transistors 80, 78, and 76 are bypassed by larger transistor 82), and ILIM_ON is negated as soon as node 85 reaches the trip point. That is, node 85 is no longer controlled by the slower path providing the analog timer. Therefore, note that MUX 22 couples the output of amplifier 12 to the control electrode of transistor 14, in response to negation of ILIM_ON, when an over current condition does not exist, or when an over voltage condition occurs after detection of an over current condition but prior to the timer's expiration. MUX 22 couples voltage clamp 30 to the control electrode of transistor 14, in response to assertion of ILIM_ON, when an over current condition exists and the timer has not expired and an over voltage condition does not occur.

Figure 5:
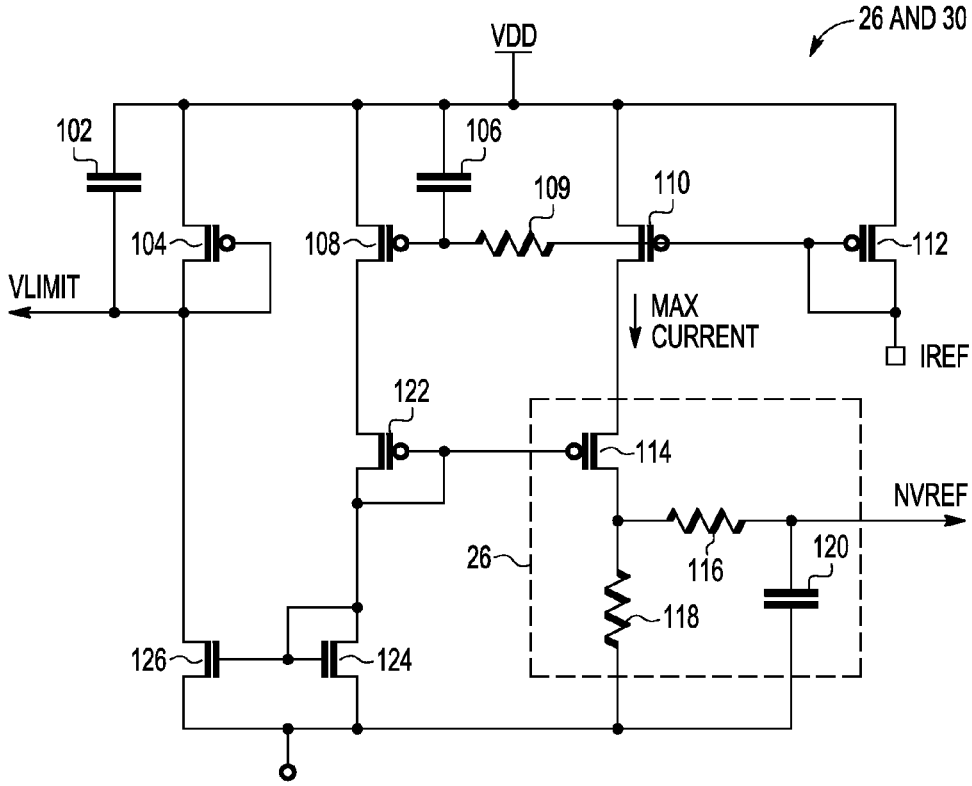
FIG. 5 illustrates, in schematic form, another portion of the voltage regulator of FIG. 1 in further detail, in accordance with one embodiment of the disclosure.

FIG. 5 illustrates further details of current to voltage converter 26 and voltage clamp 30, in accordance with one embodiment. FIG. 5 includes PMOS transistors 104, 110, 112, 122, and 114, NMOS transistors 126 and 124, capacitors 102, 106, and 120, and resistors 109, 116, and 118. A first terminal of capacitor 102 is coupled to VDD, and a second terminal of capacitor 102 is coupled to VLIMIT (which represents the output of voltage clamp 30 which is selectively coupled to the control electrode of transistor 14 through MUX 22). A first current electrode of transistor 104 is coupled to VDD, a second current electrode of transistor 104 is coupled to the second terminal of capacitor 102, and a control electrode of transistor 104 is coupled to the second current electrode of transistor 104. A first current electrode of transistor 108 is coupled to VDD, and a second current electrode of transistor 108 is coupled to a first current electrode of transistor 122. A second current electrode of transistor 122 is coupled to a control electrode of transistor 122 and a first current electrode of transistor 124. A second current electrode of transistor 124 is coupled to ground. A first current electrode of transistor 126 is coupled to the second current electrode of transistor 104, and a second current electrode of transistor 126 is coupled to ground. A control electrode of transistor 124 is coupled to the first current electrode of transistor 124 and to a control electrode of transistor 126. A first terminal of capacitor 106 is coupled to VDD, and a second terminal of capacitor 106 is coupled to a control electrode of transistor 108. A first terminal of resistor 109 is coupled to the control electrode of transistor 108. A first current electrode of transistor 110 is coupled to VDD, a control electrode of transistor 110 is coupled to a second terminal of resistor 109, and a second current electrode of transistor 110 is coupled to a first current electrode of transistor 114. A control electrode of transistor 114 is coupled to the control electrode of transistor 122, and a second current electrode of transistor 114 is couple to a first terminal of resistor 118 and a first terminal of resistor 116. A second terminal of resistor 118 is coupled to ground. A second terminal of resistor 116 provides output NVREF to over current detection circuit 28. A first terminal of capacitor 120 is coupled to the second terminal of resistor 116, and a second terminal of capacitor 120 is coupled to ground. A first current electrode of transistor 112 is coupled to VDD, and a second current electrode of transistor 112 is coupled to receive IREF (which corresponds to the current received from max current reference 18). A control electrode of transistor 112 is coupled to the second current electrode of transistor 112 and to the control electrode of transistor 110.

In operation, the maximum current reference, IREF, provided to the second current electrode of transistor 112 is mirrored by transistor 110 and provided to transistor 114. Transistor 114, resistors 116 and 118, and capacitor 120 operate as current to voltage converter 26 and thus converts the maximum current reference provided to transistor 114 to voltage NVREF. A scaled version of the maximum current, filtered by capacitor 106 and resistor 109, is provided through transistor 122 and transistor 124 and mirrored by transistor 126. When VLIMIT is coupled to the control electrode of transistor 14 by MUX 22, the current through transistor 14 is fixed by the current through transistor 104. In this manner, the current through transistor 14 is clamped. In the illustrated embodiment, the same IREF provided by maximum current reference 18 is used by both over current detection circuit 28 and voltage clamp 30.

Therefore, by now it can be appreciated how the use of detection circuits may be used to protect a load from over current conditions and over voltage conditions. Furthermore, by clamping the ballast transistor upon occurrence of an over current condition for a predetermined amount of time (as determined by analog timer 36), the average overall current provided to load 20 can be maintained at a lower level rather than providing clamping without use of a timer to maintain the clamp for the predetermined amount of time. Also, in order to further protect the circuit, during this predetermined amount of time in which the ballast transistor is clamped, monitoring for over voltage conditions can be performed so that the feedback loop may be immediately closed, prior to expiration of the predetermined amount of time, in response to occurrence of an over voltage condition.

The terms "assert" or "set" and "negate" (or "deassert" or "clear") are used herein when referring to the rendering of a signal, status bit, or similar apparatus into its logically true or logically false state, respectively. If the logically true state is a logic level one, the logically false state is a logic level zero. And if the logically true state is a logic level zero, the logically false state is a logic level one.

Because the apparatus implementing the present invention is, for the most part, composed of electronic components and circuits known to those skilled in the art, circuit details will not be explained in any greater extent than that considered necessary as illustrated above, for the understanding and appreciation of the underlying concepts of the present invention and in order not to obfuscate or distract from the teachings of the present invention.

Although the invention has been described with respect to specific conductivity types or polarity of potentials, skilled artisans appreciated that conductivity types and polarities of potentials may be reversed.

Moreover, the terms "front," "back," "top," "bottom," "over," "under" and the like in the description and in the claims, if any, are used for descriptive purposes and not necessarily for describing permanent relative positions. It is understood that the terms so used are interchangeable under appropriate circumstances such that the embodiments of the invention described herein are, for example, capable of operation in other orientations than those illustrated or otherwise described herein.

Although the invention is described herein with reference to specific embodiments, various modifications and changes can be made without departing from the scope of the present invention as set forth in the claims below. For example, each block of voltage regulator 10 may be performed using different circuit implementations. Accordingly, the specification and figures are to be regarded in an illustrative rather than a restrictive sense, and all such modifications are intended to be included within the scope of the present invention. Any benefits, advantages, or solutions to problems that are described herein with regard to specific embodiments are not intended to be construed as a critical, required, or essential feature or element of any or all the claims.

The term "coupled," as used herein, is not intended to be limited to a direct coupling or a mechanical coupling.

Furthermore, the terms "a" or "an," as used herein, are defined as one or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more" or "at least one" and indefinite articles such as "a" or "an." The same holds true for the use of definite articles.

Unless stated otherwise, terms such as "first" and "second" are used to arbitrarily distinguish between the elements such terms describe. Thus, these terms are not necessarily intended to indicate temporal or other prioritization of such elements.

The following are various embodiments of the present invention.

Item 1 includes a voltage regulator including an amplifier having a first input coupled to a first reference voltage and a second input coupled to a voltage feedback signal; a multiplexer having a first input coupled to an output of the amplifier, a second input coupled to a voltage clamp signal, and a control input; a control circuit having a first input coupled to an over current indicator, a second input coupled to a no over voltage indicator, a third input coupled to a timer signal, and an output coupled to the control input of the multiplexer. Item 2 includes the voltage regulator of item 1, and further includes a load circuit coupled to the second input of the amplifier. Item 3 includes the voltage regulator of item 2, and further includes a ballast transistor having a gate terminal coupled to an output of the multiplexer, a source terminal coupled to a supply voltage, and a drain terminal coupled to the load circuit and the second input of the amplifier. Item 4 includes the voltage regulator of item 1, and further includes a current scalar transistor having a gate terminal coupled to the output of the multiplexer, a source terminal coupled to a supply voltage, and a drain terminal coupled to an input of a first current to voltage converter circuit. Item 5 includes the voltage regulator of item 4, and further includes the first current to voltage converter circuit configured to provide a scaled current to an over current detection circuit, and the over current detection circuit outputs the over current indicator. Item 6 includes the voltage regulator of item 5, and further includes a second current to voltage converter circuit having an input coupled to a maximum reference current supply and an output coupled to the over current detection circuit. Item 7 includes the voltage regulator of item 6, wherein the over current detection circuit (28) includes a comparator circuit. Item 8 includes the voltage regulator of item 1, and further includes an over voltage detection circuit having a first input coupled to a second reference voltage, a second input coupled to the voltage feedback signal, and an output that provides the no over voltage indicator. Item 9 includes the voltage regulator of item 8, wherein the over voltage detection circuit includes a comparator circuit. Item 10 includes the voltage regulator of item 1, and further includes an analog timer circuit configured to provide the timer signal, wherein current output by the voltage regulator is limited until the timer signal expires when an over current condition is detected and an over voltage condition is not detected.

Item 11 includes a voltage regulator including: a regulator control circuit having a first input coupled to an over current indicator, a second input couple to a no over voltage indicator, a third input coupled to a timer signal, and an output coupled to provide a control signal; and a multiplexer having a first input coupled to an amplifier output signal, a second input coupled to a voltage limit signal, and a control input coupled to the control signal, wherein the multiplexer outputs the amplifier output signal when an over current condition does not exist and an over voltage condition exists, and the multiplexer outputs the voltage limit signal when the over current condition exists and the timer signal has not expired when the over voltage condition does not exist. Item 12 includes the voltage regulator of item 11, wherein the multiplexer outputs the amplifier output signal when the over voltage condition does not exist and the timer signal has expired. Item 13 includes the voltage regulator of item 11, and further includes an amplifier coupled to receive a reference voltage at a first input and a feedback voltage at a second input and to output the amplifier output signal, wherein the feedback voltage is based on a regulator supply voltage coupled to a load. Item 14 includes the voltage regulator of item 13, and further includes an over voltage detection circuit configured to compare a second reference voltage to the feedback voltage and to set a no over voltage indicator to indicate whether the over voltage condition exists. Item 15 includes the voltage regulator of item 11, and further includes an over current detection circuit configured to compare a scaled current to a maximum current and to set an over current indicator to indicate whether the over current condition exists. Item 16 includes the voltage regulator of item 15, and further includes an analog timer circuit coupled to receive the over current indicator and the no over voltage indicator and to output an unexpired timer signal for a selected amount of time. Item 17 includes the voltage regulator of item 11, and further includes a ballast transistor having a gate terminal coupled to an output of the multiplexer, a source terminal coupled to a supply voltage, and a drain terminal coupled to a load circuit. Item 18 includes the voltage regulator of item 11, and further includes a current scalar transistor having a gate terminal coupled to an output of the multiplexer, a source terminal coupled to a supply voltage, and a drain terminal coupled to an input of a first current to voltage converter circuit.

Item 19 includes a method of regulating voltage, including when current required by a load device is greater than a maximum current: limiting current supplied to the load device, activating a timer; and when voltage supplied to the load device is less than or equal to a maximum voltage: waiting until the timer expires before again allowing the load device to draw an amount of current greater than the maximum current. Item 20 includes the method of item 19 and further includes when voltage supplied to the load device is greater than the maximum voltage, supplying a regulated voltage to the load device.

What is claimed is:

1. A voltage regulator comprising:

an amplifier having a first input coupled to a first reference voltage and a second input coupled to a voltage feedback signal;

a multiplexer having a first input coupled to an output of the amplifier, a second input coupled to a voltage clamp signal, and a control input, wherein when the control input selects the first input, the voltage regulator operates in a closed loop in which the voltage feedback signal is regulated and when the control input selects the second input, the voltage regulator operates in an open loop in which the voltage feedback signal is not regulated;

a control circuit having a first input coupled to an over current indicator, a second input coupled to a no over voltage indicator, a third input coupled to a timer signal, and an output coupled to the control input of the multiplexer.

2. The voltage regulator of claim 1, further comprising:

a load circuit coupled to the second input of the amplifier.

3. The voltage regulator of claim 2, further comprising:

a ballast transistor having a gate terminal coupled to an output of the multiplexer, a source terminal coupled to a supply voltage, and a drain terminal coupled to the load circuit and the second input of the amplifier.

4. The voltage regulator of claim 1, further comprising:

a current scalar transistor having a gate terminal coupled to the output of the multiplexer, a source terminal coupled to a supply voltage, and a drain terminal coupled to an input of a first current to voltage converter circuit.

5. The voltage regulator of claim 4, further comprising:

the first current to voltage converter circuit configured to provide a scaled current to an over current detection circuit, and the over current detection circuit outputs the over current indicator.

6. The voltage regulator of claim 5, further comprising:

a second current to voltage converter circuit having an input coupled to a maximum reference current supply and an output coupled to the over current detection circuit.

7. The voltage regulator of claim 6, wherein the over current detection circuit (28) includes a comparator circuit.

8. The voltage regulator of claim 1, further comprising:

an over voltage detection circuit having a first input coupled to a second reference voltage, a second input coupled to the voltage feedback signal, and an output that provides the no over voltage indicator.

9. The voltage regulator of claim 8, wherein the over voltage detection circuit includes a comparator circuit.

10. The voltage regulator of claim 1, further comprising:

an analog timer circuit configured to provide the timer signal, wherein current output by the voltage regulator is limited until the timer signal expires when an over current condition is detected and an over voltage condition is not detected.

11. A voltage regulator comprising:

a regulator control circuit having a first input coupled to an over current indicator, a second input couple to a no over voltage indicator, a third input coupled to a timer signal, and an output coupled to provide a control signal; and a multiplexer having a first input coupled to an amplifier output signal, a second input coupled to a voltage limit signal, and a control input coupled to the control signal, wherein the multiplexer outputs the amplifier output signal when an over current condition does not exist and an over voltage condition exists, and the multiplexer outputs the voltage limit signal when the over current condition exists and the timer signal has not expired when the over voltage condition does not exist.

12. The voltage regulator of claim 11, wherein the multiplexer outputs the amplifier output signal when the over voltage condition does not exist and the timer signal has expired.

13. The voltage regulator of claim 11, further comprising:

an amplifier coupled to receive a reference voltage at a first input and a feedback voltage at a second input and to output the amplifier output signal, wherein the feedback voltage is based on a regulator supply voltage coupled to a load.

14. The voltage regulator of claim 13, further comprising:

an over voltage detection circuit configured to compare a second reference voltage to the feedback voltage and to set a no over voltage indicator to indicate whether the over voltage condition exists.

15. The voltage regulator of claim 11, further comprising:

an over current detection circuit configured to compare a scaled current to a maximum current and to set an over current indicator to indicate whether the over current condition exists.

16. The voltage regulator of claim 15, further comprising:

an analog timer circuit coupled to receive the over current indicator and the no over voltage indicator and to output an unexpired timer signal for a selected amount of time.

17. The voltage regulator of claim 11, further comprising:

a ballast transistor having a gate terminal coupled to an output of the multiplexer, a source terminal coupled to a supply voltage, and a drain terminal coupled to a load circuit.

18. The voltage regulator of claim 11, further comprising:

a current scalar transistor having a gate terminal coupled to an output of the multiplexer, a source terminal coupled to a supply voltage, and a drain terminal coupled to an input of a first current to voltage converter circuit.

19. A method of regulating voltage, comprising:

monitoring a current of a load device; when the current required by the load device is greater than a maximum current: limiting the current supplied to the load device to a first predetermined current level being lower than or equal to the maximum current, and activating a timer; and monitoring a voltage supplied to the load device; when the voltage supplied to the load device is less than or equal to a maximum voltage: waiting until the timer expires, and allowing the load device to draw a second predetermined current level being greater than the maximum current after the timer expires.

20. The method of claim 19 further comprising:

when voltage supplied to the load device is greater than the maximum voltage, supplying a regulated voltage to the load device.

* * * * *